US005765302A

United States Patent [19]

Brandl et al.

[11] Patent Number: 5,765,302

[45] Date of Patent: Jun. 16, 1998

[54] AMMUNITION TRANSPORT IN A REPEATING WEAPON

[75] Inventors: Rudolph Brandl, Dornhan-Weiden; Heinz Matt, Oberndorf; Thomas Romer, Schramberg, all of Germany

[73] Assignee: Heckler & Koch GmbH, Germany

[21] Appl. No.: 716,168

[22] PCT Filed: Jan. 17, 1996

[86] PCT No.: PCT/EP96/00183

§ 371 Date: Nov. 14, 1996

§ 102(e) Date: Nov. 14, 1996

[87] PCT Pub. No.: WO96/22500

PCT Pub. Date: Jul. 25, 1996

[30] Foreign Application Priority Data

Jan. 18, 1995 [DE] Germany ..... 195 01 397.2

[51] Int. Cl.[6] ..... F41A 3/00

[52] U.S. Cl. ..... 42/18; 42/7; 42/22

[58] Field of Search ..... 42/18, 29, 7, 50, 42/87, 16

[56] References Cited

U.S. PATENT DOCUMENTS

| | | | |
|---|---|---|---|
| 1,913,255 | 6/1933 | Von Frommer . | |
| 3,177,603 | 4/1965 | Gillespie | 42/75 |
| 3,688,640 | 9/1972 | Seecamp | 89/138 |
| 3,731,418 | 5/1973 | Birkenhagen et al. | 42/75 B |
| 3,857,322 | 12/1974 | Lichtman | 89/145 |
| 3,892,082 | 7/1975 | Domhan | 42/11 |
| 4,132,023 | 1/1979 | Weldle | 42/7 |
| 4,161,836 | 7/1979 | Hayashi | 42/16 |
| 4,197,666 | 4/1980 | Ng | 42/59 |
| 4,589,326 | 5/1986 | Kiickens et al. | 89/145 |

FOREIGN PATENT DOCUMENTS

| | | |
|---|---|---|
| 0 291 474 | 11/1988 | European Pat. Off. . |
| 1339367 | 1/1964 | France . |
| 1598641 | 7/1970 | France . |
| 82 32 810 U | 6/1983 | Germany . |
| 38 18 838 A1 | 7/1989 | Germany . |
| 146 031 | 1/1931 | Switzerland . |

*Primary Examiner*—Charles T. Jordan
*Assistant Examiner*—Meena Chelliah
*Attorney, Agent, or Firm*—Leydig, Voit & Mayer, Ltd.

[57] ABSTRACT

An ammunition transport for use in a repeating weapon includes a transition component that presents a pair of converging sloped surfaces so that cartridges provided in a side-by-side fashion from a cartridge magazine may be transferred to a cartridge chamber of the weapon.

16 Claims, 3 Drawing Sheets

AMMUNITION TRANSPORT IN A REPEATING WEAPON

FIELD OF THE INVENTION

The invention relates to means for ammunition transport in a repeating weapon. It relates, therefore, to all firearms which automatically take cartridges from a supply and feed these to a barrel.

BACKGROUND OF THE INVENTION

As supplies there serve, for example, cartridge belts or magazines. They can be designed as fixed or as changeable components of a weapon. Fixed storages are found, for example, in repeating rifles, changeable supplies, in contrast, are found in rapid-fire weapons, submachine guns, machine guns or the like.

In the loading process the cartridges are transferred individually from the supply into a barrel or into a cartridge chamber or carrier formed on the barrel. For this purpose they are first in a so-called transfer position in the supply. From there they are thrust or drawn by a breechblock over a transition into the cartridge chamber or carrier.

The number of transfer positions is conditioned by the construction type of the supply. If the cartridges are arranged in a row in the supply, as a rule one transfer position will suffice. If, however, the cartridges are arranged in two or more rows, then two or more transfer positions may be appropriate. An important example for this are double-row magazines. Here one stands before the choice of having both rows converge into one, so that one transfer position would suffice, or choosing a construction with two transfer positions. (The last-mentioned construction has the advantage there over the first that in the same space more cartridges can be store or stocked.)

The transfer position(s) are not located, in general, directly behind the barrel or the cartridge carrier. Instead of this they are frequently arranged under the cartridge carrier or laterally displaced thereto. (Such lateral displacements are necessary when several adjacently lying transition (transfer) positions are provided.) As a very general rule, therefore, a cartridge must cover a construction-conditioned intermediate interval between a transfer position and the barrel or the cartridge carrier.

The intermediate intervals are bridged by a corresponding number of transition. Here it is a matter in the case of known repeating weapons of routings on the barrel receptor, on the barrel or generally on fixed components of the weapon. They serve also for the guidance of the cartridge on its respective path. This is expedient, because a cartridge in a transfer position in known supplies is always fixed in some manner. The breechblock, therefore, can engage the cartridge only in one partial area. This alone would not suffice, however, for an exact guidance. Such a guidance, however, is very important in order to avoid jammings and loading obstructions to loading.

The production of such transitions proves to be problematical in practice. One the one hand, they should correspond as accurately as possible to the desired dimensions, in order to ensure a guidance that is secure and insensitive to shocks. One the other hand, they are ordinarily located at least in part in places difficult to access, so that there is only little space for the processing. The desired precision, therefore, is generally not achieved. As compensation or alternatively, for example expensive guide places are used on the magazine.

SUMMARY OF THE INVENTION

Accordingly, it is a general object of the invention to improve such transitions repeating weaponry and the like.

The invention achieves this goal, with an automatic weapon with at least one cartridge supply, a barrel and a transition which bridges at least partially the interval or intervals between the cartridge supply and the barrel or a cartridge carrier formed on the barrel. In the loading process, cartridges are transported in a known manner from the supply into the barrel or into the cartridge chamber or carrier, in which process the transition or transitions serve for the guidance of the cartridges. This transition or transitions is/are constructed as, or in at least one, separate transition component.

For each transition, there can be provided a component of its own. It is also possible, however, for all the transitions to be comprised in one component. For the production any suitable materials can be used. Synthetic material is preferred. The transition component can be milled, for example, from the solid material or can be constructed as a forged part and subsequently milled. It can, however, also be constructed as a cast part. In principle, any surface precision and quality and any transition form is achievable. It is possible, therefore, freely to choose the most economical and best production process.

Moreover, the invention considerably facilitates the series manufacture of automatic weapons with individual cutting to measure. For example, one and the same basic model can easily be designed for different calibers or supplies. For this purpose it is merely necessary to put together suitable combinations of barrel, transition component and supply. The other components of the weapon, however, are no longer affected. This makes possible also an especially economical organization of the production flows.

In a preferred form of execution the transition component is constructed by pressure-casting-, metal-powder injection molding-,fine-casting-, or as a part of sintered metal, or as a plastic part. In this manner retoolings of the transition component become substantially superfluous. This holds also when individual zones or the entire component are complicated in construction. The production of the transition component thus becomes especially economical.

In a further preferred form of execution, the transition component is changeably or removably mounted to the housing. In this manner it also becomes possible subsequently to alter automatic weapons, without disadvantages such has having to accept into the bargain an unsuitable transition form or an offset between transition and supply. In this manner loading obstacles in converted weapons can be effectively avoided. This is advantageous especially in the case of overproductions of individual forms of execution or subsequent wishes of the customer for alterations. It makes possible, however, also the delivery of the weapons as conversion set. Therewith, lastly, the customer himself can arrange the weapon for the type of cartridges which is best suited for his particular requirements. Thus it is possible, for example, to convert a submachine gun at will for the cartridge 9 mm Parabellum or the cartridge .45 ACP, or for cartridges with special projectile forms (truncated missiles). For this it is merely necessary to assemble in each case a suitable barrel, a magazine, a breechblock and a transition component in suitable manner.

Finally, this form of execution makes it possible in case of damages to the transition, to change exclusively this component. Hitherto in such cases it was necessary to retire the barrel or even the whole weapon. The economicalness of repeating weapons is thus considerably improved.

In a further preferred form of execution, the transition component stands in closed-form engagement with the barrel. Preferably there,the closed-form engagement is constructed as a tongue-and-groove system. This makes possible an especially simple fastening of the transition component in the weapon, since only the barrel still has to be fixed. If one chooses for each combination of barrel and transition component a different-type closed form engagement, then, furthermore, confusions can be avoided. Especially in the case of issuing convertible weapons to military personal this can be very advantageous.

In a further preferred form of execution the cartridge supply is constructed as a magazine which is inserted into a reception space. The transition component is seated with its underside on the upper side of the front wall of the magazine. The rear end of the transition component connects, there, to the inner surface of the front wall of the magazine, essentially snugly. In this manner the transition approaches as near as possible to the transfer position. Unevennesses, damages or the like on the guide plate of the magazine can therefore no longer have a negative effect on the transport of the cartridges. The demands for a careful manufacture and treatment of the magazine can thus be lowered without impairing the quality of the weapon. Especially when cartridges of different length or missile form are to be used, this is very advantageous. Frequently, namely, in the magazine of the shorter cartridges in each case relatively thick walls must be domed in order to fit the magazine to the reception opening. Damages such as, say, dents would impair the guidance of the cartridge here especially severely.

In a further preferred form of execution the transition component is not wider than the reception space. A recess accessible through this space is provided for the transition component. The transition component there, in the installation or change is thrust through the receiving space into the recess. This has the advantage that the transition component can be changed especially easily.

BRIEF DESCRIPTION OF THE DRAWINGS

The invention is explained in more detail with the aid of examples of execution and of the appended drawing. In the drawing.

DETAILED DESCRIPTION OF THE PREFERRED EMBODIMENTS

Figure 1:
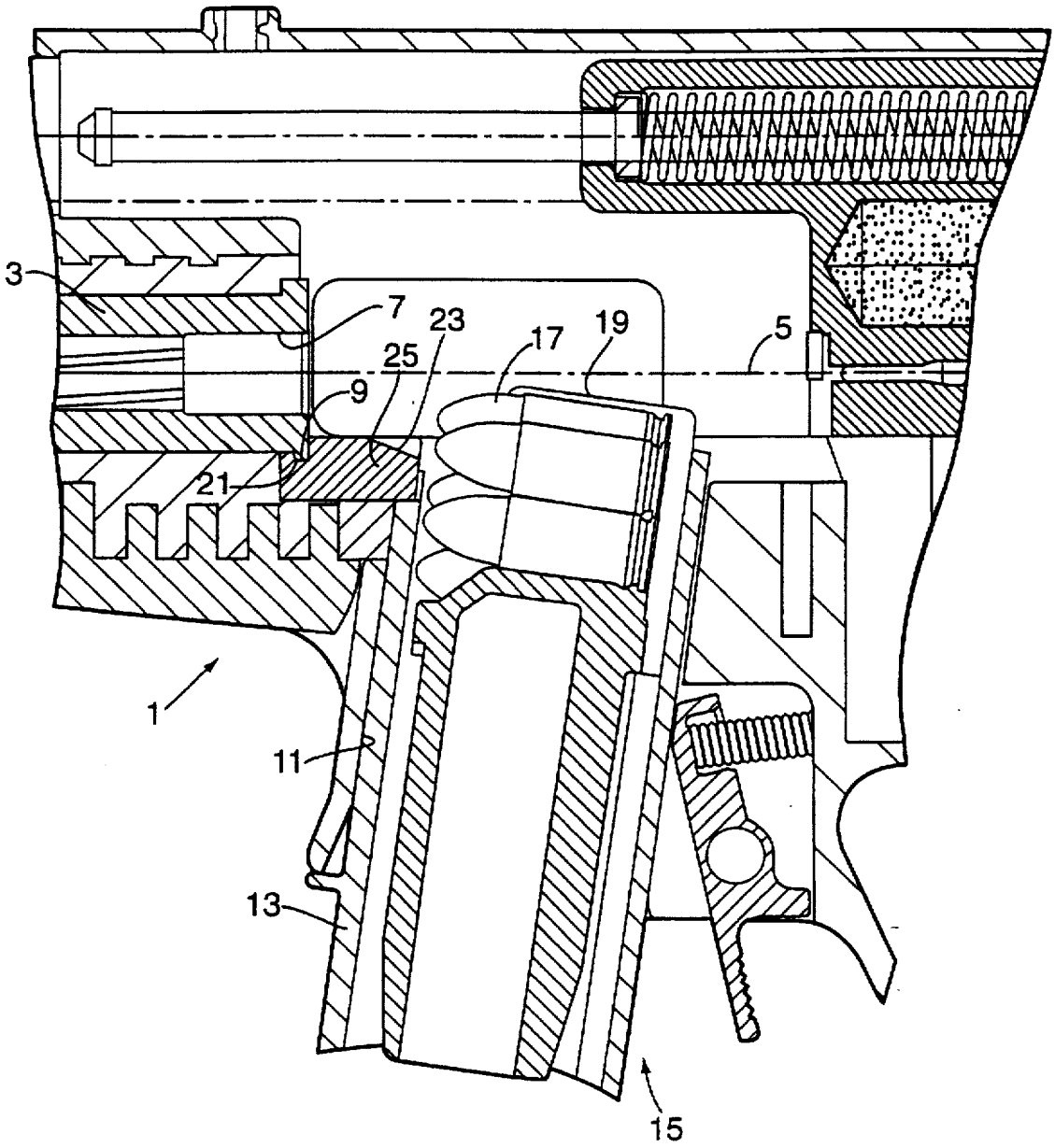
FIG. 1 is a partial longitudinal section through a submachine gun according to the invention, which is arranged for the cartridge 9 mm Parabellum.

In FIG. 1 the submachine gun has, in usual manner a housing 1, in which a barrel 3 is exchangeably arranged and is held by means of a cap nut. This is suited for the cartridge 9 mm Parabellum. The longitudinal axis of the barrel bore there is designated as bore axis 5. The rear end of the bore is constructed as cartridge chamber or carrier 7. At the rear end the barrel has on its outside a collar projecting in the manner of a flange, which is constructed on its underside as a crossbar 9.

In the housing 1 there is formed a magazine shaft 11, which extends about perpendicularly to the bore axis 5 and the central axis (not shown) of which intersects with the bore axis 5. In the magazine shaft 11 there is seated a magazine 15, which has a front wall 13 of relatively thick sheet metal or other material, two side walls and a rear wall. The upper ends of the side walls are extended and constructed as two magazine lips 19 lying opposite one another (only 1 represented).

The cartridges brought up by a follower by action of a magazine spring (not shown) are arranged in two adjacently lying rows offset from one another. The uppermost cartridge 17 is held by the magazine lip 19 allocated to it in its position, and is present in the transfer position which is assigned to its row. Now when the breechblock (no reference number) is moved forward along the bore axis 5, this cartridge 17 is then gripped on its base and introduced into the cartridge chamber or carrier 7. In order to ensure a dependable guidance of the cartridge 17, there is arranged a transition component 25. This is constructed in the example as a feed ramp.

On the feed ramp 25 there is formed a guide surface 23. In the loading process first of all the cartridge tip of the uppermost cartridge 17 runs onto this surface. The cartridge 17 is then introduced into the cartridge chamber or carrier 7. In the process also the circumference of this cartridge 17 runs on beyond the guide surface 23. This is inclined in such manner that it or its imagined extension impinges on the underside of the rear inner circumferential edge of the cartridge chamber or carrier 7.

On the front side the feed ramp 25 has a cross-groove 21 in which the crosspiece 9 engages at the rear outer circumferential end of the barrel 3. When the barrel 3 is arranged in the housing 1 so that it lies firmly in longitudinal direction, then it also holds fast the feed ramp 25. The feed ramp 25 is seated there in a receptacle which is formed in the housing 1. Alternatively, the feed ramp 25 could also be permanently fastened. For example, it would be possible for this purpose to inject it into the housing.

The rear end of the feed ramp 25 extends into the magazine shaft 11 through a distance which corresponds about to the wall thickness of the front wall 13 of the magazine 15. It ends, therefore, at or shortly before the inner surface of the front wall 13.

In conversion of the weapon for another caliber, first of all the breechblock is removed. Then the barrel 3, after releasing of the cap nut together with the feed ramp 25, can be thrust to the rear out of the housing 1, until the latter is present in the magazine shaft 11. By a rotation of the barrel 3 the feed ramp 25 is released from this. It can thereupon be removed from the housing 1. The installation occurs in reverse sequence. It is also possible to remove the feed ramp 25 together with the barrel 3 from the housing 1, and then to unhinge the feed ramp 25 from the barrel 3.

Figure 3:
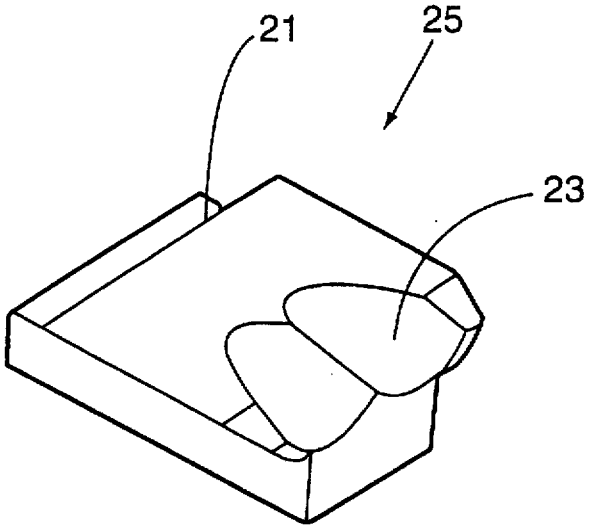
FIG. 3 an elevation view of the transition component from FIG. 1.

In FIG. 3 the feed ramp 25 is represented as an individual part. Here there is to be seen especially well the complicated shaping of the guide surface 23. This has two transitions in the form of guide grooves which are directed in each case from one of the two transfer positions (in each case beside a magazine lip 19) against the under edge of the cartridge chamber 7. Since therewith the guide surfaces 23 would intersect before the cartridge chamber 7, they bridge the intermediate interval only up to this section line.

Figure 2:
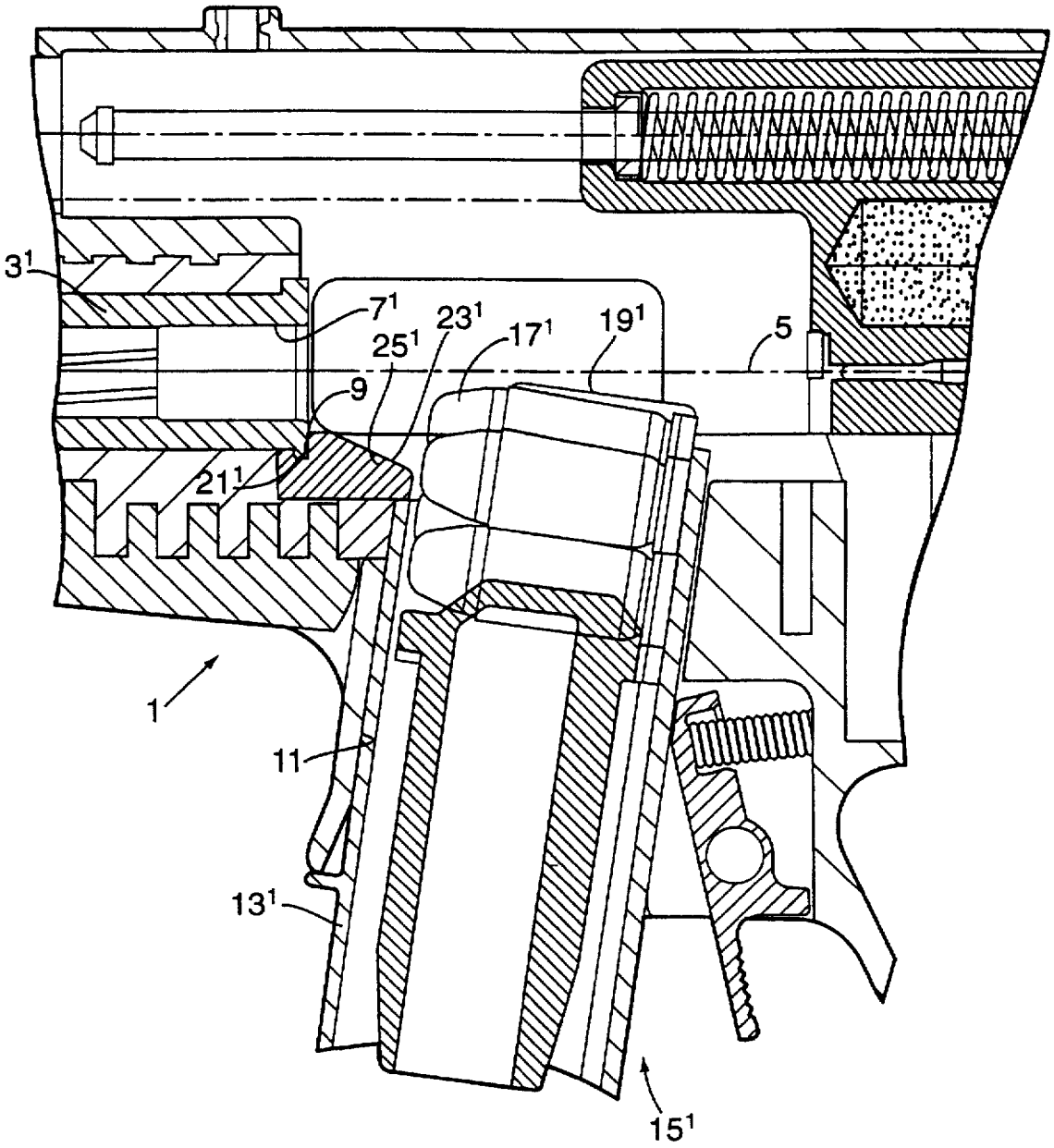
FIG. 2 a partial longitudinal section through the submachine gun from FIG. 1, which is arranged for the cartridge .45 ACP (Automatic)

In FIG. 2 there is represented the same housing as in FIG. 1. To be sure, there are installed therein a barrel 3' for the cartridge .45 ACP (.45 Automatic), a magazine 15' fitting this and an appertaining feed ramp 25'. The cartridge .45 ACP is longer and thicker than the cartridge 9 mm Parabellum. The magazine 15' must, in order to fit into the shaft 11, have the same dimensions in the cross section as the magazine 15. For this reason the wall thicknesses are less. The feed ramp 25' extends correspondingly less far into the magazine shaft 11. Otherwise the description of FIG. 1 holds correspondingly.

Figure 4:
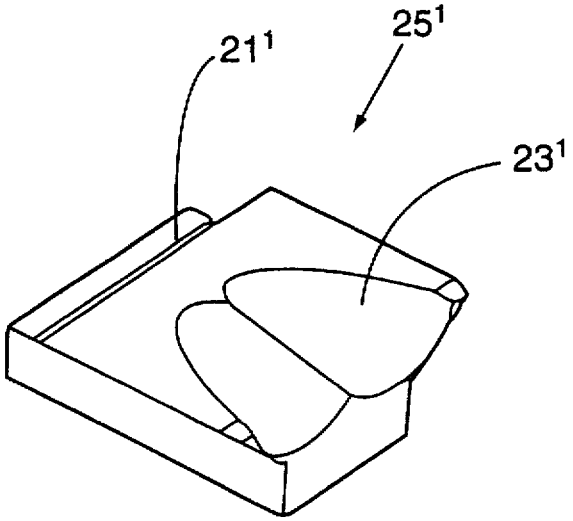
FIG. 4 an elevation view of the transition component from FIG. 2.

In FIG. 4 the feed ramp 25' is represented as an individual part. The guide surface 23' lies lower than the guide surface 23 of the feed ramp, since the diameter of the cartridge chamber 7' is greater than that of the cartridge chamber 7. The guide grooves are likewise adapted to the greater diameter.

Finally, the crossbar 9' and the cross groove 21' are differently designed than cross bar 9 and cross groove 21, in order to avoid that the possibility that the feed ramp can be inadvertently suspended in a barrel belonging to another caliber.

What is claimed is:

1. A repeating weapon adapted to automatically load cartridges of a first type comprising:

a weapon housing;

at least one separable cartridge magazine releasably attached to the weapon housing, the cartridge magazine presenting the cartridges of the first type in an alternating side-by-side fashion;

a longitudinally extending barrel attached to the weapon housing opposite the cartridge magazine including a cartridge chamber disposed at one of the barrel ends; and a transition region which at least partly bridges the cartridge magazine and the cartridge chamber including a removable transition component disposed in fixed position relative to the cartridge magazine and the cartridge chamber having a pair of converging sloped guide surfaces, each of the pair of guide surfaces adapted to at least partially alternatingly receive the cartridges of the first type from the cartridge magazine to orient same to the cartridge chamber.

2. The invention as in claim 1 wherein the transition component is constructed by pressure-molding.

3. The invention as in claim 1 wherein the transition component is constructed by metal powder injection molding.

4. The invention as in claim 1 wherein the transition component is constructed by fine molding.

5. The invention as in claim 1 wherein the transition component is constructed of sintered metal.

6. The invention as in claim 1 wherein the transition component is constructed as a unitary plastic piece part.

7. The invention as in claim 1 wherein the transition component, the barrel and the cartridge magazine containing cartridges of the first type are removable from the weapon housing such that a second barrel, a second cartridge magazine containing cartridges of a second type and a second transition component adapted to orient the cartridges of the second type toward the second barrel may be installed in the weapon housing.

8. The invention as in claim 7 wherein the transition component is disposed in closed-linkage engagement with the barrel.

9. A transition component for use in an automatic or semiautomatic firing weapon including a weapon housing, a longitudinally extending barrel with a cartridge chamber disposed at one end, a magazine shaft disposed to engage a cartridge magazine proximate to the cartridge chamber adapted to alternatingly present one cartridge from adjacent rows of cartridges to a first and a second transfer position, a breechblock disposed to move the cartridge disposed in one of the first and second transfer positions to the cartridge chamber, and a recess provided between the cartridge chamber and the magazine shaft, the transition component comprising:

a removable transistion element adapted to interfit within the recess formed between the cartridge chamber and the magazine shaft, the transition element including a pair of ramped surfaces providing a path to orient a cartridge disposed at one of the first and second transfer positions toward the cartridge chamber upon actuation of the breechblock.

10. The invention as in claim 9 wherein the ramped surfaces are each formed as grooved surfaces upwardly sloping from respective ones of the transfer positions toward the cartridge chamber.

11. The invention as in claim 10 wherein the grooved surfaces lie in overlapping relation.

12. The invention as in claim 11 wherein each of the grooved surfaces define axes that are disposed at an angle with respect to the barrel axis of the weapon.

13. The invention as in claim 11 wherein the cartridge chamber further comprises a flange disposed at one of its ends and wherein the transition component further comprises a laterally extending groove sized to receive the flange.

14. A repeating weapon adapted to automatically load cartridges of a first type and of a second type comprising:

a weapon housing including a magazine shaft;

a first separable cartridge magazine releasably attached to the magazine shaft, the first cartridge magazine including a front wall and presenting cartridges of the first type in an alternating side-by-side fashion;

a first longitudinally extending barrel releasably attached to the weapon housing opposite the first cartridge magazine including a first cartridge chamber disposed at one of the first barrel ends;

a first transition region which at least partly bridges the first cartridge magazine and the first cartridge chamber when the first cartridge magazine and the first barrel are attached to the housing, the first transition region including a recess contiguous with the magazine shaft;

a first removable transition component disposed in the first transition region in closed linkage engagement with the first barrel in a fixed position relative to the first cartridge magazine and the first cartridge chamber, the first transition component having a pair of converging sloped guide surfaces adapted to at least partially receive the cartridges of the first type to orient same from the first cartridge magazine to the first cartridge chamber, the first transition component being dimensioned to be removed from the recess or located therein by passage through the magazine shaft;

a second separable cartridge magazine releasably attached to the magazine shaft when the first cartridge magazine is removed therefrom, the second cartridge magazine presenting cartridges of the second type;

a second longitudinally extending barrel attached to the weapon housing opposite the second cartridge magazine when the first barrel is removed therefrom, the second barrel including a second cartridge chamber disposed at one of the second barrel ends; and a second transition component adapted to orient cartridges of the second type from the second cartridge magazine to the second barrel when the second cartridge magazine and the second barrel are attached to the housing.

15. The invention as in claim 14 wherein the cartridge magazine is defined by a front wall and wherein at least a portion of the transition component is in abutting relation with the cartridge magazine front wall.

16. The invention as in claim 15 wherein the cartridge magazine is releasably attached to a magazine shaft disposed in the housing and wherein the transition region includes a recess contiguous with the magazine shaft adapted to receive the transition component, the transition component being dimensioned to be removed from the recess or located therein by passage through the magazine shaft.

* * * * *